US012102113B2

(12) United States Patent
Richard

(10) Patent No.: US 12,102,113 B2
(45) Date of Patent: Oct. 1, 2024

(54) METHOD AND APPARATUS TO CAST A WEB OF A MATERIAL CONTAINING ALKALOIDS

(71) Applicant: PHILIP MORRIS PRODUCTS S.A., Neuchatel (CH)

(72) Inventor: Yann Richard, Grandevent (CH)

(73) Assignee: Philip Morris Products S.A., Neuchatel (CH)

( * ) Notice: Subject to any disclaimer, the term of this patent is extended or adjusted under 35 U.S.C. 154(b) by 672 days.

(21) Appl. No.: 17/251,858

(22) PCT Filed: Jun. 28, 2019

(86) PCT No.: PCT/EP2019/067417
§ 371 (c)(1),
(2) Date: Dec. 14, 2020

(87) PCT Pub. No.: WO2020/002644
PCT Pub. Date: Jan. 2, 2020

(65) Prior Publication Data

US 2021/0244073 A1 Aug. 12, 2021

(30) Foreign Application Priority Data

Jun. 29, 2018 (EP) ..... 18181013

(51) Int. Cl.
*A24B 3/14* (2006.01)
*A24B 15/14* (2006.01)
*A24C 5/01* (2020.01)

(52) U.S. Cl.
CPC ..... *A24B 3/14* (2013.01); *A24B 15/14* (2013.01); *A24C 5/01* (2020.01)

(58) Field of Classification Search
CPC ..... A24B 3/14; A24B 15/14; A24C 5/01
See application file for complete search history.

(56) References Cited

U.S. PATENT DOCUMENTS 3,053,259 A * 9/1962 Parmele ..... A24B 15/14 131/370
10,575,549 B2 3/2020 Soo
2017/0340001 A1 11/2017 Soo

FOREIGN PATENT DOCUMENTS

EP 0565360 10/1993
GB 1 459 218 12/1976
(Continued)

OTHER PUBLICATIONS

Search Report and Written Opinion for PCT/EP2019/067417 dated Sep. 20, 2019 (11 pages).
(Continued)

*Primary Examiner* — Christopher M Rodd
*Assistant Examiner* — Jennifer A Kessie
(74) *Attorney, Agent, or Firm* — Mueting Raasch Group

(57) ABSTRACT

The present invention relates to a method to cast a web of a material containing alkaloids, including the steps of: —Providing a tank (22) with a piston (23); —Filling the tank with slurry; —Providing a casting box (24) fluidly connected to the tank; —Pushing the slurry in the tank by means of the piston in order to transfer slurry from the tank to the casting box; and —Casting the slurry from the casting box to obtain the web of a material containing alkaloids. The present invention also relates to an apparatus (10) to cast a web of a material containing alkaloids.

15 Claims, 1 Drawing Sheet

(56) References Cited

FOREIGN PATENT DOCUMENTS

| | | | |
|---|---|---|---|
| JP | 53-26838 | | 8/2013 |
| JP | 2018504090 | A | 2/2018 |
| KR | 1020180037867 | | 4/2018 |
| RU | 175178 | | 11/2017 |

OTHER PUBLICATIONS

Office Action issued in Japan for Application No. JP2020-570419 dated Jun. 5, 2023 (8 pages). English translation included.
Office Action issued in Russia for Application No. 2021101922 dated Oct. 27, 2022 (16 pages). English translation included.

* cited by examiner

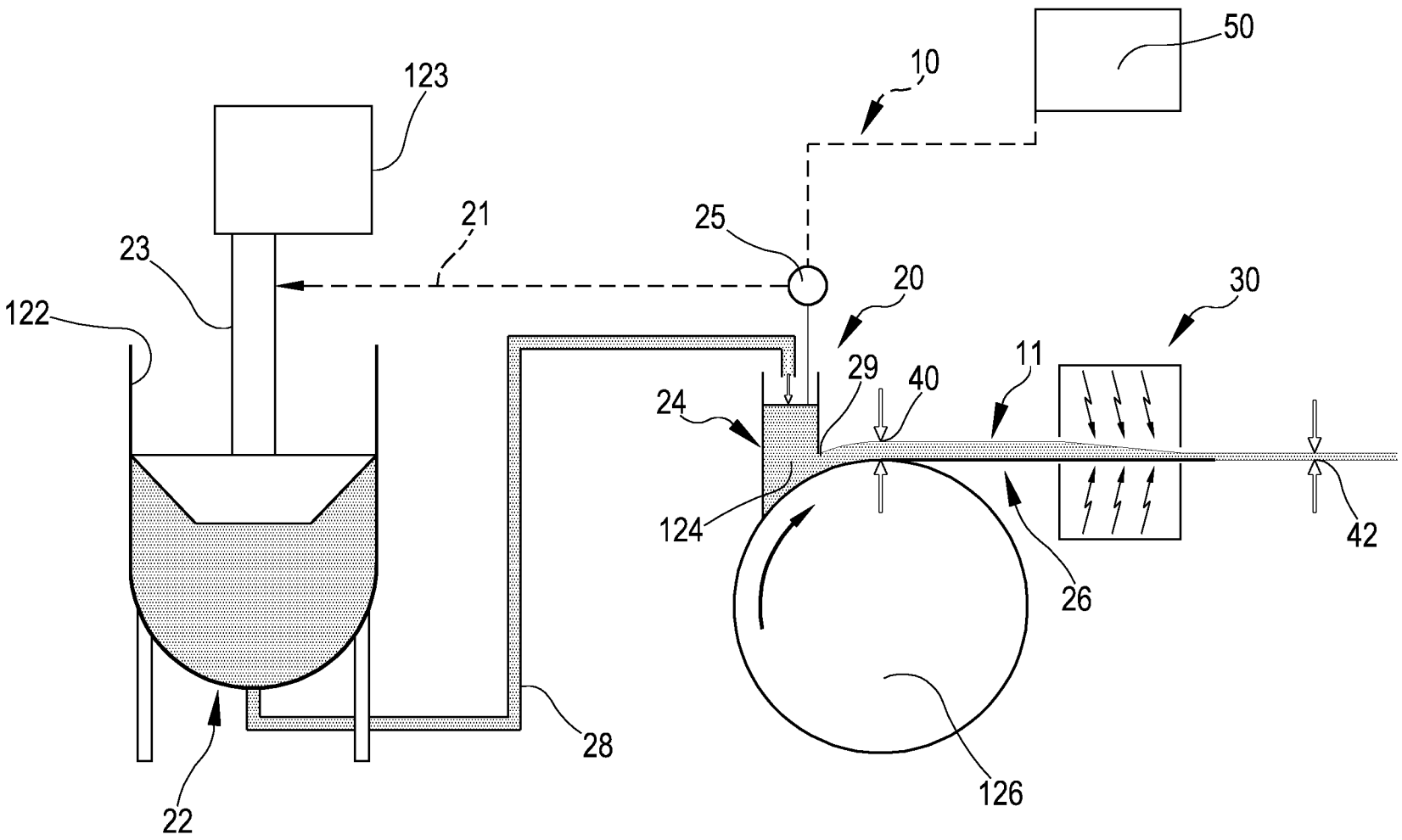
50
10
30
42
11
26
126
20
40
29
25
24
124
28
21
123
23
122
22

METHOD AND APPARATUS TO CAST A WEB OF A MATERIAL CONTAINING ALKALOIDS

This application is a U.S. National Stage Application of International Application No. PCT/EP2019/067417 filed Jun. 28, 2019, which was published in English on Jan. 2, 2020 as International Publication No. WO 2020/002644 A1. International Application No. PCT/EP2019/067417 claims priority to European Application No. 18181013.6 filed Jun. 29, 2018.

The present invention is related to a method to cast a web of a material containing alkaloids.

Furthermore, the present invention is related to an apparatus to cast a web of a material containing alkaloids.

In particular, the invention relates to a web of homogenized tobacco material, preferably used in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf (TCL is the acronym for tobacco cast leaf). The process to form homogenized tobacco material sheets commonly comprises a step in which tobacco dust and a binder are mixed to form a tobacco slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. A process for making such homogenized tobacco is for example disclosed in European Patent EP 0565360.

In a "heat-not-burn" aerosol-generating article, an aerosol-forming substrate is heated to a relatively low temperature, in order to form an aerosol but prevent combustion of the tobacco material. Further, the tobacco present in the homogenized tobacco material is typically the only tobacco, or includes the majority of the tobacco, present in the homogenized tobacco material of such a "heat-not burn" aerosol-generating article. This means that the aerosol composition that is generated by such a "heat-not burn" aerosol-generating article is substantially only based on the homogenized tobacco material. Therefore, it is important to have good control over the composition of the homogenized tobacco material for the control, for example, of the taste of the aerosol.

Due to variations in the physical properties of the slurry, for example, consistency, viscosity, fibre size, particle size, moisture or the age of the slurry, standard casting methods and apparatus may result in unintended variations in the application of the slurry onto a support during the casting of web of homogenized tobacco. A non-optimal casting method and apparatus may lead to inhomogeneity and defects in the cast web of homogenized tobacco.

Inhomogeneity in the homogenized tobacco web may lead to difficulties in subsequent handling of the homogenized tobacco web in the production of the aerosol-generating article. For example, inhomogeneity may lead to tearing of the web or even rupture of the web during manufacture or further processing of the web. This in turn could, for example, result in machine stops. Additionally, an inhomogeneous tobacco web may create unintended difference in the aerosol delivery between aerosol generating articles that are produced from the same homogenized tobacco web.

Regarding the overall manufacturing process of web of homogenized tobacco material, different parameters are critical for the final product quality and consistency. One of these parameters is the pressure of the slurry inside the casting box. Even a slight variation of pressure from one slurry production batch to another could alter the homogeneity of the web of homogenized tobacco material that may then be reject according to the tight quality standards of the industry.

The slurry may be formed in a tank. A pump may be used to send the tobacco slurry from the tank, which can be the manufacturing silo or a temporary storage silo, usually cylindrical and having a relatively large diameter, typically greater than 1 meter, to the casting box. With the pump, a determined flow of slurry is sent from the silo to the casting box.

However, the slurry may have a high viscosity, and in turn a high resistance to flow. Furthermore, the piping network usually have, from the silo to the casting box, many divergences and turns due to usual factory configurations.

All these factors, for example slurry viscosity, turns and divergences of piping network, are known in fluid mechanics to increase the pressure drop, which is the drop of pressure of the fluid from its starting point to its destination. The pressure drop is due to frictional forces: the slurry has to use energy to overcome the frictional forces it encounters, and, since the slurry flow parameters, which are related to the slurry kinetic energy, are fixed by the pump, the energy is provided by the pressure of the slurry (under Bernoulli's principle), hence the pressure drop.

Thus, in the case of a process of manufacturing of a web of material containing alkaloids, the pressure of the slurry in the casting box could be altered by variations of the frictional forces opposed to the slurry flow in the piping network, and such variations could occur from one slurry production batch to another. The variations may have different causes, for example slight changes of slurry viscosity, clusters of previously flowed slurry stuck in the pipes, or others.

It would be desirable to have a solution to send the slurry to the casting box of the production lines preventing as much as possible variations of the pressure in the casting box, to improve homogeneity of the homogenized tobacco material web.

The invention relates to a method to cast a web of a material containing alkaloids, including the steps of providing a tank with a piston; filling the tank with slurry; providing a casting box fluidly connected to the tank; pushing the slurry in the tank by means of the piston in order to transfer slurry from the tank to the casting box; and casting the slurry from the casting box to obtain the web of a material containing alkaloids.

Advantageously, the method of the invention includes pushing the slurry in the tank by means of the piston provided in the tank, so that a "pressure driven system" is substantially defined. Such pressure driven system prevents or limits pressure drops and allows the possibility to have a better control of the slurry pressure inside the destination casting box.

As used herein, the terms "sheet" denotes a laminar element having a width and length substantially greater than the thickness thereof. The width of a sheet is preferably greater than about 10 millimeters, more preferably greater than about 20 millimeters or about 30 millimeters. Even more preferably, the width of the sheet is comprised between about 100 millimeters and about 300 millimeters. A continuous "sheet" is herein called "web".

As used herein, the term "casting blade" denotes a longitudinally shaped element that may have an essentially constant cross-section along major parts of its lengthwise extension. It shows at least one edge that is intended to come into contact with a pasty, viscous or liquid-like substance to be influenced by said edge, such as a slurry. Said edge may have a sharp and knife-like shape. Alternatively, it may have a rectangular or a rounded shape.

As used herein, the term "movable support" denotes any means comprising a surface that can be moved in at least one longitudinal direction. The movable support may form a closed loop so as to provide an uninterrupted transporting ability in one direction. However, the movable support may be moved in a back and forth moving way as well. The movable support may include a conveyor belt. The movable support may be essentially flat and may show a structured or an unstructured surface. The movable support may show no openings in its surface or may show only orifices of such a size that they are impenetrable for the slurry deposited on it. The movable support may comprise a sheet-like movable and bendable band. The band may be made of a metallic material, including but not limited to steel, copper, iron alloys and copper alloys, or of a rubber material. The band may be made of a temperature-resistant material so that it can be heated to speed up the drying process of the slurry.

As used herein, the term "slurry" denotes a liquid-like, viscous or pasty material that may comprise an emulsion of different liquid-like, viscous or pasty material and that may contain a certain amount of solid-state particles, provided that the slurry still shows a liquid-like, viscous or pasty behaviour.

A "material containing alkaloids" is a material which contains one or more alkaloids. The alkaloids may comprise nicotine. The nicotine may be found, for example, in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

As used herein, the term "homogenised tobacco material" denotes material formed by agglomerating particulate tobacco, which contains the alkaloid nicotine. The material containing alkaloids can thus be a homogenized tobacco material.

The most commonly used forms of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making.

The homogenized tobacco material sheet can be also referred to as a reconstituted sheet material and formed using particulate tobacco (for example, reconstituted tobacco) or a tobacco particulate blend, a humectant and an aqueous solvent to form the tobacco composition. This tobacco composition may be then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The homogenized tobacco sheet generally includes, in addition to the tobacco, a binder and an aerosol-former, such as guar and glycerin.

As used herein, the term "aerosol forming material" denotes a material that is capable of releasing volatile compounds upon heating to generate an aerosol. Tobacco, together with other compounds, may be classified as an aerosol forming material, particularly a sheet of homogenized tobacco comprising an aerosol former. An aerosol forming substrate may comprise or consist of an aerosol forming material. The homogenized tobacco sheet can be used as an aerosol forming material.

The slurry may comprise a number of different components or ingredients. These components may influence the properties of the cast web of material containing alkaloids. A first ingredient is a material containing alkaloids, for example in powder form. This material can be for example a tobacco powder blend, which preferably contains the majority of the tobacco present in the slurry. The tobacco powder blend is the source of the majority of tobacco in the homogenized tobacco material and thus gives the flavor to the final product, for example to an aerosol producing article. A cellulose pulp containing cellulose fibers is preferably added to the slurry in order to increase the tensile strength of the alkaloids material web, acting as a strengthening agent. Preferably, a binder is added. Preferably, an aerosol-former is added. Binder and aerosol-former are preferably added in order to enhance the tensile properties of the homogenized sheet and promote the formation of aerosol. Further, in order to reach a certain viscosity and moisture optimal for casting the web of material containing alkaloids, water may be added to the slurry. The slurry may be mixed in order to render it as homogeneous as possible.

The quantity of binder added to the slurry may be comprised between about 1 percent and about 5 percent in dry weight of the slurry. More preferably, it is comprised between about 2 percent and about 4 percent. The binder used in the slurry may be any of the gums or pectins described herein. The binder may ensure that the tobacco powder remains substantially dispersed throughout the homogenized tobacco web. Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

The introduction of cellulose fibres in the slurry typically increases the tensile strength of the tobacco material web, acting as a strengthening agent. Therefore, adding cellulose fibres may increase the resilience of the homogenized tobacco material web. Cellulose fibres for including in a slurry for homogenized tobacco material are known in the art and include, but are not limited to: soft-wood fibres, hard wood fibres, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof. Cellulose fibres may include tobacco stem materials, stalks or other tobacco plant material. Preferably, cellulose fibres such as wood fibres comprise a low lignin content. Alternatively, fibres, such as vegetable fibres, may be used either with the above fibres or in the alternative, including hemp and bamboo. The length of cellulose fibres is advantageously between about 0.2 millimetres and about 4 millimetres. Preferably, the mean length per weight of the cellulose fibres is between about 1 millimetre and about 3 millimetres. Further, preferably, the amount of the cellulose fibres is comprised between about 1 percent and about 7 percent in dry weight basis of the total weight of the slurry (or homogenized tobacco sheet).

Suitable aerosol-formers for inclusion in slurry for homogenised tobacco material are known in the art and include, but are not limited to: monohydric alcohols like menthol, polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Examples of preferred aerosol-formers are glycerine and propylene glycol.

The slurry may have an aerosol-former content of greater than about 5 percent on a dry weight basis. The slurry may have an aerosol former content of between about 5 percent and about 30 percent by weight on a dry weight basis. More preferably, the aerosol-former is comprised between about 10 percent to about 25 percent of dry weight of the slurry. More preferably, the aerosol-former is comprised between about 15 percent to about 25 percent of dry weight of the slurry.

The binder and the cellulose fibers are preferably included in a weight ratio comprised between about 1:7 and about 5:1. More preferably, the binder and the cellulose fibers are included in a weight ratio comprised between about 1:1 and about 3:1.

The binder and the aerosol-former are preferably included in a weight ratio comprised between about 1:30 and about 1:1. More preferably, the binder and the aerosol-former are included in a weight ratio comprised between about 1:20 and about 1:4.

Preferably, the alkaloid containing material is tobacco. The binder and the tobacco particles are preferably included in a weight ratio comprised between about 1:100 and about 1:10. More preferably, the binder and the tobacco particles are included in a weight ratio comprised between about 1:50 and about 1:15, even more preferably between about 1:30 and 1:20.

The aerosol-former and the tobacco particles are preferably included in a weight ratio comprised between about 1:20 and about 1:1. More preferably, the aerosol-former and the tobacco particles are included in a weight ratio comprised between about 1:6 and about 1:2.

The aerosol-former and the cellulose fibres are preferably included in a weight ratio comprised between about 1:1 and about 30:1. More preferably, the aerosol-former and the cellulose fibres are included in a weight ratio comprised between about 5:1 and about 15:1.

The cellulose fibres and the tobacco particles are preferably included in a weight ratio comprised between about 1:100 and about 1:10. More preferably, the cellulose fibres and the tobacco particles are preferably included in a weight ratio comprised between about 1:50 and about 1:20.

The slurry is located initially in a tank, for example the silo where it is formed, from where it is transferred to a casting box. Preferably, the slurry is continuously supplied to the casting box while the slurry is cast onto a movable support by means of a casting device, such as for example a casting blade or a casting roller to form a continuous web of material containing alkaloids. The tank and the casting box are thus fluidly connected in order to allow the slurry flow from one to the other. The connection may include suitable piping.

The casting-box is preferably box-shaped and preferably includes sidewalls. The box can be open on the upper side or might include a lid or a top wall. In addition, the casting box may include a bottom wall having an aperture, or might be open at the bottom.

According to the invention, a piston is located in the tank, for example above a top surface of the slurry in the tank. The piston is used to press the slurry out of the tank into the piping network leading to the casting box of the production line. Movements of the piston push the slurry out of the tank, compressing the same. Movements of the piston may include vertical movements. This is a pressure driven system that is different from the usual flow driven system using the pump. The pressure driven system prevents or minimizes pressure drops, because it controls the pressure applied, and thus allows having a better control of the slurry pressure inside the destination casting box. In addition, less energy loss in piping network than in the flow driven system may take place.

Preferably, the method of the invention includes a step of monitoring a pressure inside the casting box. Advantageously, a pressure sensor is used in the casting box.

More preferably, the method of the invention includes changing a pressure applied by the piston to the slurry on the basis of the pressure measured inside the casting box. Advantageously, the pressure exerted by the piston on the slurry is adjusted according to pressure sensors reading the pressure within the casting boxes, so that there is a pressure regulation loop whose purpose is to keep the pressure in the casting box within a predetermined range.

Preferably, the step of pushing the slurry in the tank by the piston in order to transfer slurry from the tank to the casting box terminates when a relative pressure inside the casting box is comprised between about 0.1 bars and about 2 bars. Indeed the target pressure inside the casting boxes is advantageously within the range between about 0.1 and about 2 bars (relative bars). This is a preferred range because below 0.1 bars, the pressure may not be enough to get the viscous slurry out of the casting box. Further, above 2 bars, the pressure drop in the apparatus might be significantly increased leading to an increase of wear of the pipes or of the casting unit (that is, casting box and casting device).

In a preferred embodiment, the web of material containing alkaloids is a homogenized tobacco sheet.

The invention also relates to an apparatus to cast a web of a material containing alkaloids, the apparatus comprising: a tank adapted to contain slurry; a movable piston adapted to exert a given pressure to the slurry, the movable piston being positioned in the tank; a casting box in fluid communication with the tank, the casting box being adapted to contain slurry received from the tank and to cast it; and a movable support adapted to receive the slurry cast from the casting box.

Advantageously, the method of the invention can be carried out by the apparatus of the invention, including the movable piston positioned in the tank. Indeed, a "pressure driven system" is substantially defined, which is different from the "flow driven system" including a pump and has the same advantages mentioned above according to the first aspect.

The tank adapted to contain slurry is preferably the tank where the slurry is stored before being sent to the casting box of the production lines, so it could be where the slurry is manufactured or where it is transferred after being manufactured. The tank may supply a single casting box, or more than one casting box.

Preferably, the tank has a substantially cylindrical shape and has a relatively large diameter, for example equal or larger than 1 meter.

Preferably, the casting box forms a pressurized enclosure. For example, the casting box could be closed. For example, the casting box may include a lid. Preferably, a control over the pressure within the casting box can be made, so that the flow of slurry out of the casting box is additionally controlled by means of acting on the level of the internal pressure of the casting box.

Advantageously, the casting box served by the tank is airtight, so that the pressure generated by the piston in the tank is directly linked to the pressure of the slurry in the casting box, allowing a good control on the slurry pressure during the casting. In this manner, a very homogeneous casting may be obtained.

The tank may be fluidly connected with a single casting box or with a plurality of casting boxes.

Preferably, the apparatus of the invention includes a pressure sensor adapted to measure a pressure inside the casting box. Advantageously, the pressure exerted by the piston on the slurry is adjusted according to pressure sensors reading the pressure within the casting boxes, so that there is a pressure regulation loop whose purpose is to keep the pressure in the casting box within a predetermined range. In particular, each casting box served by the tank has at least one pressure sensor whose reading is used to command the actuating force pushing the piston inside the tank and generating the pressure pushing the slurry from the tank to the casting boxes. This pressure control loop allows having an accurate control on the slurry pressure inside the casting box.

Preferably, the apparatus of the invention includes a casting blade adapted to cast the slurry contained in the casting box onto the movable support so as to form the cast web of the material containing alkaloids. Advantageously, the slurry is distributed onto the movable support through a gap that is formed between the casting blade and the movable support. The casting blade is used in order to form a cast web of slurry which has a substantially uniform thickness onto the movable support. The distance between the blade and the support, that is, the dimension of the gap, determines—among others—the thickness of the cast web of slurry.

Preferably, a mean distance between said casting blade and said movable support is comprised between about 0.1 millimeters and about 2 millimeters, more preferably, the mean distance between said casting blade and said support is comprised between about 0.2 millimeters and about 1.5 millimeters, even more preferably between about 0.5 millimeters and about 1 millimeter. The thickness of the cast web of a material containing alkaloids is very relevant for the quality and consistency of the finished product. It is desired that the thickness is homogeneous, that is free of any lumps, agglomerates, fibers and coarse particles. The created gap between blade and support ensures that the slurry is cast in a continuous web of uniform thickness.

In a preferred embodiment, the apparatus of the invention includes a pipe connecting the tank to the casting box. Preferably, the tank is in fluid communication with a plurality of casting boxes. Advantageously, the piston presses the slurry out of the tank into the piping network leading to the casting boxes of the production lines.

In a preferred embodiment, the movable piston is actuated by a hydraulic press or an electric screw. In this way the pressure in the casting box can be easily controlled.

In a preferred embodiment, the inner surface of the tank has a roughness $R_a$ lower than about 0.8 micron. Advantageously, such a roughness $R_a$ ensures a correct sliding of the piston along the inner surface of the tank.

Preferably, the apparatus of the invention includes a control unit in signal communication with the pressure sensor, wherein the control unit is adapted to command an actuator to drive the movable piston in response to a signal received from said pressure sensors in order to perform a feedback loop to vary the pressure inside the casting box in response to said signal. A feedback loop is implemented, in order to keep the pressure of the casting box substantially constant or within a desired range. The presence of defects, for example of draggers, and their locations, which can be identified by the sensor(s) present in the casting apparatus, as well as an inhomogeneity in the thickness of the web of homogenized tobacco material, which can also be revealed by the sensor(s), implicitly indicates the presence of non-optimal casting conditions. These non-optimal casting conditions can be due to several factors. Therefore, advantageously, a plurality of sensors is used in order to obtain values of parameters which play a role in the casting process. These values can then in turn be adjusted with the feedback loops, for example when the conditions of the casting would cause the production of cast web to be outside of the desired specifications. The appearance of defects or non-uniformities or the shift of a parameter outside a standard pre-set range is detected by one or more sensors and a corresponding signal is sent to the central control unit.

In a preferred embodiment, the movable piston has a diameter comprised between about 1 centimeter and about 90 centimeters, more preferably between about 5 centimeters and about 15 centimeters. In another embodiment, the movable piston has a diameter preferably comprised between about 50 centimeters and about 3 meters.

The invention may also relate to a method to cast a web of a material, including the steps of: providing a tank with a piston; filling the tank with slurry; providing a casting box fluidly connected to the tank; pushing the slurry in the tank by means of the piston in order to transfer slurry from the tank to the casting box; and casting the slurry from the casting box to obtain the web of a material.

The invention may also relate to an apparatus to cast a web of a material, the apparatus comprising: a tank adapted to contain slurry; a movable piston adapted to exert a given pressure to the slurry, the movable piston being positioned in the tank; a casting box in fluid communication with the tank, the casting box being adapted to contain slurry received from the tank and to cast it; and a movable support adapted to receive the slurry cast from the casting box.

Further features and advantages of the invention will become apparent from the detailed description thereof with non-limiting reference to the appended drawing, wherein FIG. 1 is a schematic lateral view of an apparatus for the production of a homogenized tobacco material including an apparatus to cast a web of a material containing alkaloids according to the invention.

With initial reference to FIG. 1, an apparatus for the production of a web of material containing alkaloids according to the present invention is represented and indicated with reference number 10.

The apparatus 10 for the production of a web of material containing alkaloids, in particular, a web 11 of homogenized tobacco material, preferably homogenized tobacco sheet, includes a casting apparatus 20 realized according to the present invention and further preferably also a drying apparatus 30 positioned downstream the casting apparatus 20 in the direction of motion of the web 11 of homogenized tobacco material.

The casting apparatus 20 comprises a tank 22 adapted to contain slurry, for example a slurry buffer, a casting box 24 in fluid communication with the tank 22 and a movable support 26 adapted to receive the slurry cast from the casting box 24.

The apparatus 20 includes a pipe 28 connecting the tank 22 to the casting box 24.

In general, the tank 22 is in fluid communication with a plurality of casting boxes 24 (only one visible in FIG. 1) through a plurality of respective pipes 28 (only one visible ion FIG. 1), which form a piping network.

A movable piston 23 is positioned in the tank 22, preferably at a top of the tank 24 and can slide therein, and is adapted to exert a given pressure to the slurry. The piston 23 presses the slurry out of the tank 22 into the pipe 28 leading to the casting box 24 of the production line.

Casting box 24 is adapted to contain slurry received from the tank 22 and to cast it.

Casting box 24 forms a pressurized enclosure. The apparatus 20 includes a pressure sensor 25 adapted to measure a pressure inside the casting box 24.

Casting box 24 served by the tank 22 is airtight and contains only slurry, so that the pressure generated by the piston 23 in the tank 22 is directly linked to the pressure of the slurry in the casting box 24, allowing to have a great control on the slurry pressure during the casting, so as to obtain a very homogeneous casting.

The tank 22 has a substantially cylindrical shape and has a relatively large diameter. The movable piston 23 has a diameter substantially corresponding to the inner diameter of the tank 22. The diameter of the piston 23 is preferably comprised between about 50 centimeters and about 3 meters.

The inner surface 122 of the tank 22 has a roughness $R_a$ lower than about 0.8 micron. Such a roughness $R_a$ ensures a correct sliding of the piston 23 along the inner surface 122 of the tank 22.

The movable piston 23 is actuated by a hydraulic press 123 or an electric screw.

The casting box 24 may have any geometrical shape, for example substantially a prism. The casting box has an opening 124 in correspondence of its bottom and the opening 124 extends along a width of the casting box 24. The apparatus 20 includes a casting blade 29 adapted to cast the slurry contained in the casting box 24 onto the movable support 26 so as to form the cast web 11 of homogenized tobacco material. The casting blade 29 is fixed to the casting box 24.

The casting blade 29 has a main dimension which is its width and it is fixed to the casting box 24 at or in proximity of its opening 124 at the bottom. Preferably, the longitudinal width of the casting blade 29 is between about 100 mm and about 3000 mm depending on the desired width of the cast web 11 of slurry.

The casting blade 29 is attached to the casting box 24 preferably by means of an adjustable board (not visible in the drawing) which allows a precise control of the position of the casting blade 29. The adjustable board includes a plurality of adjustment elements to adjust a gap between the blade 29 and the support 26. The casting box 24 and the casting blade 29 are mounted above a main drum 126 which rotates the movable support 26.

The slurry is distributed onto the movable support 26 through a gap that is formed between the casting blade 29 and the movable support 26, the dimensions of which determine—among others—the thickness of the cast web 11 of homogenized tobacco material. The casting blade 29 is used in order to form a cast web 11 of slurry which has a substantially uniform thickness onto the movable support.

The dimension of the gap is controlled by controlling the position of the casting blade 29 by means of the adjustable board which includes the adjusting elements distributed along its width.

Preferably, the breadth of the gap is comprised between about 0.1 mm and about 2 mm, and more preferably between about 0.2 mm and about 1.5 mm.

The movable support 26 comprises for example a continuous stainless steel belt comprising a drum assembly. The drum assembly includes a main drum 126 located below the casting box 24 which moves the movable support 26. Preferably, the casting box 24 is mounted on top of the main drum 126.

The apparatus 20 further includes a control unit 50 in signal communication with the pressure sensor 25, wherein the control unit 50 is adapted to command the hydraulic press 123 to drive the movable piston 23 in response to a signal received from the pressure sensor 25 in order to perform a feedback loop to vary the pressure, which is detected by the pressure sensor 25, inside the casting box 24 in response to the signal.

Furthermore, the control unit 50 is preferably also in signal communication with other sensors (not depicted in the drawings) for example one or more of: a sensor to identify draggers on the cast web 11 cast on the movable support 26; a sensor to determine the moisture of the cast web 11 cast on the movable support 26; a sensor to measure the thickness or variations in thickness of the cast web 11 cast on the movable support 26; a sensor to measure the viscosity of the slurry in the casting box 24; a sensor to measure the temperature of the slurry in the casting box 24; a sensor to detect the position of defects on the cast web 11 cast on the movable support 26; a sensor to detect the density of the slurry in the casting box 24; and combinations of two or more of the above sensors.

Preferably, all the sensors send signals relative to their respective parameters to be measured (pressure, temperature, moisture slurry level, defects, and so on) to the control unit 50. The control unit is preferably electrically connected to one, to some or to all of the piston actuators (hydraulic press 123 or electric screw), other actuators, motors or to further circuits in the casting apparatus 20. In case the cast web 11 reveals defects or inhomogeneity or the characteristics of the cast web 11 are outside a preset range, the control unit can instruct changes in the process parameters and thus influence characteristics of the slurry or the parameters of the casting. These process parameters may be for example the dimension of the gap between the casting blade 29 and the support 26 or the pressure in the casting box 24. For example, a feedback loop to the actuators of the casting blade 29 is present to adjust the thickness of the cast web 11.

The drying apparatus 30 includes a plurality of individual drying zones. Each drying zone preferably includes steam heating on the bottom side of the movable support 26 and heated air above the movable support 26 and preferably also adjustable exhaust air control. Within the drying apparatus 30, the homogenized tobacco web 11 is dried to desired final moisture on the movable support 26. The web 11 of homogenized tobacco material enters the drying apparatus 30 with a thickness 40 and exits from the drying apparatus 30 with a reduced thickness 42.

The functioning of the apparatus 10 including the casting apparatus 20 is as follows. The slurry, formed preferably by mixing and combining tobacco powder and other ingredients, is filled in the tank 22, which is provided with the piston 23.

The slurry is transferred from the tank 22 to one or more casting box(es) 24, which are fluidly connected to the tank 22 through respective pipe(s) 28.

The slurry in the tank 22 is pushed by means of the piston 23 in order to transfer the slurry from the tank 22 to the casting box 24 or to apply a given pressure to the slurry in the casting box 24.

The slurry is cast from the casting box 24 to obtain the web 11 of homogenized tobacco material.

The casting step of the slurry into a web 11 of homogenous and uniform film thickness is performed on the movable support 26, including for example the stainless steel belt.

The pressure sensor 25 is provided in the casting box 24 and it is used to monitor the pressure inside the casting box 24. The pressure exerted by the piston 23 on the slurry in the tank 22 is adjusted according to pressure sensor 25 reading the pressure within the casting boxes 24, so that there is a pressure regulation loop 21 whose purpose is to keep the pressure in the casting box 24 within a predetermined range. In particular, the reading of the pressure sensor 25 is used to command the actuating force pushing the piston 23 inside the tank 22 and generating the pressure to push the slurry from the tank 22 to the casting box 24. This pressure regulation loop 21 allows having an accurate control on the slurry pressure inside the casting box 24.

The step of pushing the slurry in the tank 22 by the piston 23 terminates when a relative pressure inside the casting box 24 is comprised between about 0.1 bars and about 2 bars (relative bars).

The thickness of the web 11 of homogenized tobacco material and grammage thereof is preferably continuously monitored and feedback-controlled using slurry measuring device. The casting is performed by means of the casting blade 29 forming a gap with the movable support 26, wherein such gap can also be feedback controlled. The shape of the casting blade 29 allows the reproducible formation of a substantially uniform web 11 of homogenized tobacco material.

Further, the cast web 11 undergoes a drying step by means of the drying apparatus 30. The drying step includes preferably a uniform and gentle drying of the cast web 11 in an endless, stainless steel belt dryer with individually controllable zones. During the drying, a monitoring step of the cast web 11 temperature at each drying zone to ensure a gentle drying profile at each drying zone is preferably performed. The cast web 11 is dried to a desired final moisture on the stainless steel belt of the movable support 26, preferably with a steam pan heating from bottom and with top air drying. Every drying zone is equipped with steam flow and pressure control so that air temperature and air flow are fully adjustable to provide the desired drying profile and to ensure that a product residence time is respected.

Preferably, at the end of the casting step and of the drying step, the homogenized tobacco material web 11 is removed from the movable support 26. Doctoring of the cast web 11 after the drying station at the right moisture content is preferably performed. The cast web 11 goes preferably through a secondary drying process to remove further moisture content of the web 11 to reach moisture target or specification. Preferably, in this secondary drying step, the cast web 11 is laid onto a wire, such that moisture can be easily removed from both surfaces of the web 11. After the drying step(s), the cast web 11 is preferably wound in one or more bobbins in a winding step.

The invention claimed is:

1. Method to cast a web of a material containing alkaloids, including the steps of:

providing a tank with a piston;

filling the tank with slurry;

providing a casting box fluidly connected to the tank;

pushing the slurry in the tank by means of the piston in order to transfer slurry from the tank to the casting box; and casting the slurry from the casting box to obtain the web of a material containing alkaloids.

2. Method according to claim 1, including the step of monitoring a pressure inside the casting box.

3. Method according to claim 1, including changing a pressure applied by the piston to the slurry in the tank in the pushing step on the basis of the pressure measured inside the casting box.

4. Method according to claim 1, wherein the step of pushing the slurry in the tank by the piston in order to transfer slurry from the tank to the casting box terminates when a relative pressure inside the casting box is comprised between about 0.1 bars and about 2 bars.

5. Method according to claim 1, wherein the web of material containing alkaloids is a homogenized tobacco sheet.

6. An apparatus to cast a web of a material containing alkaloids, the apparatus comprising:

a tank adapted to contain slurry;

a movable piston adapted to exert a given pressure to the slurry, the movable piston being positioned in the tank;

a casting box in fluid communication with the tank, the casting box being adapted to contain slurry received from the tank and to cast it; and a movable support adapted to receive the slurry cast from the casting box.

7. Apparatus according to claim 6, wherein the casting box forms a pressurized enclosure.

8. Apparatus according to claim 6, including a pressure sensor adapted to measure a pressure inside the casting box.

9. Apparatus according to claim 6, including a casting blade adapted to cast the slurry contained in the casting box onto the movable support so as to form the cast web of the material containing alkaloids.

10. Apparatus according to claim 6, including a pipe connecting the tank to the casting box.

11. Apparatus according to claim 6, wherein the tank is in fluid communication with a plurality of casting boxes.

12. Apparatus according to claim 6, wherein the movable piston is actuated by an hydraulic press or an electric screw.

13. Apparatus according to claim 6, wherein the inner surface of the tank has a roughness Ra lower than about 0.8 micron.

14. Apparatus according to claim 8, including a control unit in signal communication with the pressure sensor, wherein the control unit is adapted to command an actuator to drive the movable piston in response to a signal received from said pressure sensors in order to perform a feedback loop to vary the pressure inside the casting box in response to said signal.

15. Apparatus according to claim 6 wherein the movable piston has a diameter comprised between about 1 centimeter and about 3 meters.

* * * * *